US005763109A

United States Patent [19]

Tabuchi et al.

[11] Patent Number: 5,763,109

[45] Date of Patent: Jun. 9, 1998

[54] METAL MATRIX COMPOSITE AND PROCESS FOR PRODUCING THE SAME

[75] Inventors: Hiroshi Tabuchi; Akihiko Takahashi, both of Ibaraki-ken, Japan

[73] Assignee: Sumitomo Chemical Company, Limited, Osaka, Japan

[21] Appl. No.: 607,634

[22] Filed: Feb. 27, 1996

[30] Foreign Application Priority Data

Feb. 28, 1995 [JP] Japan ..... 7-039946

[51] Int. Cl.[6] ..... B32B 15/16; C22C 32/00

[52] U.S. Cl. ..... 428/640; 428/469; 419/19

[58] Field of Search ..... 428/544, 614, 428/629, 632, 640, 372, 469; 419/19

[56] References Cited

U.S. PATENT DOCUMENTS

| | | | |
|---|---|---|---|
| 4,935,055 | 6/1990 | Aghajanian et al. | 164/66.1 |
| 5,523,074 | 6/1996 | Takahashi et al. | 423/625 |
| 5,612,267 | 3/1997 | Bachelard et al. | 501/127 |

FOREIGN PATENT DOCUMENTS

| | | |
|---|---|---|
| 6460987 | 12/1991 | European Pat. Off. . |
| 0644278 | 3/1995 | European Pat. Off. . |
| 62 013501 A | 1/1987 | Japan . |
| 63 243248 A | 10/1988 | Japan . |
| 02122043 A | 5/1990 | Japan . |
| WO93/08311 | 4/1993 | WIPO . |

OTHER PUBLICATIONS

"The Effect of Particulate Loading on the Mechanical Behaviour of $Al_2O_3$/Al Metal–Matrix Composites," M.K. Aghajanian, et al., *Journal of Materials Science, 28*, 1993, pp. 6683–6690 No month available.

Keikinzoku–gakkai, 8th Spring Meeting (1993.5) Abstract (with complete translation).

"Aluminium Alloy–$Al_2O_3$ Platelets Composite Processing and Mechanical Properties," V. Massardier et al., Riso International Symposium of Materials Science (12th) Roskilde, pp. 503–508.

*Primary Examiner*—Peter Chin

*Assistant Examiner*—Sean Vincent

*Attorney, Agent, or Firm*—Sughrue, Mion, Zinn, Macpeak & Seas, PLLC

[57] ABSTRACT

A metal matrix composite comprising 2 to 80 volume % of α-alumina powder as a reinforcement, said α-alumina powder comprises polyhedral primary particles substantially having no fracture surface, D50 of α-alumina powder is 0.1 μm to 50 μm and a ratio of D50 to D10 is not more than 2, wherein D10 and D50 are particle sizes at 10% and 50% cumulation from the smallest particle side of a weight cumulative particle size distribution, respectively, and a process for producing the metal matrix composite which comprises infiltrating a molten metal into the α-alumina powder under pressure or non-pressure.

17 Claims, No Drawings

METAL MATRIX COMPOSITE AND PROCESS FOR PRODUCING THE SAME

FIELD OF THE INVENTION

The present invention relates to a metal matrix composite, and a process for producing the same. More particularly, it relates to a metal matrix composite comprising specific α-alumina powder as a reinforcement, and a process for producing the same.

BACKGROUND OF THE INVENTION

Metal matrix composites have attracted special interest as a material which is useful for applications requiring specific strength, specific rigidity, etc., and various studies about combinations of reinforcements and matrixes, production processes, etc. have hitherto been made.

In the composite, various ceramic particles are commonly used as reinforcements, and it is known that characteristics of the composite (e.g. mechanical strength, wear resistance, etc.) depend largely on properties of the reinforcement. When using alumina particles as the reinforcement, alumina powder obtained by grinding electrically fused alumina or sintered alumina has frequently been used as the reinforcement, heretofore.

For example, Journal of Materials Science Vol. 28, page 6683 (1983) discloses an aluminum matrix composite using ground α-alumina powder as the reinforcement.

Japanese Patent Kokai (laid-open) No. 63-243248 discloses a magnesium matrix composite using alumina particles (e.g. electrically fused alumina, etc.) as the reinforcement.

Japanese Patent Kokai (laid-open) No. 62-13501 discloses a copper matrix composite using fine particles of alumina as the reinforcement.

The Japan Institute of Light Metal, 84th Meeting in Spring Season (1993, May), Collection of Preliminary Manuscripts discloses an aluminum matrix composite using spherical particles of fine-particles comprising corundum (α-alumina) as a main component and mullite as the reinforcement.

In Japanese Patent Kokai (laid-open) No. 2-122043 discloses a cylinder liner made of a hypereutectic aluminum-silicon alloy matrix composite using α-alumina powder having no sharp edge as the reinforcement and graphite powder as a lubricant.

Riso International Symposium on Materials Science (12th), Roskilde, page 503 (1991) discloses an aluminum matrix composite using hexagonal tabular α-alumina powder having an aspect ratio (same as ratio of long diameter to short diameter) of 5 to 25 as the reinforcement.

However, the alumina powders used as reinforcements in these known composites are prepared through a grinding process and, therefore, the strength of particles is low. In addition, the particle size distribution is wide or ratio of the long diameter to short diameter is large and, therefore, packing properties are liable to become inferior. Consequently, the metal matrix composite using the alumina powder as the reinforcement had a problem that the mechanical strength and wear resistance are not necessarily sufficient.

Under these circumstances, the present inventors have studied intensively so as to obtain a metal matrix composite which is superior in mechanical strength and wear resistance. As a result, it has been found that a metal matrix composite comprising specific α-alumina powder as the reinforcement is superior in mechanical strength and wear resistance. Thus, the present invention has been accomplished.

OBJECTS OF THE INVENTION

A main object of the present invention is to provide a metal matrix composite which is superior in mechanical strength and wear resistance.

This object as well as other objects and advantages of the present invention will become apparent to those skilled in the art from the following description.

SUMMARY OF THE INVENTION

That is, the present invention provides a metal matrix composite comprising 2 to 80 volume % of α-alumina powder as a reinforcement, said α-alumina powder comprises polyhedral primary particles substantially having no fracture surface, D50 of α-alumina powder is 0.1 μm to 50 μm and a ratio of D50 to D10 is not more than 2, wherein D10 and D50 are particle sizes at 10% and 50% cumulation from the smallest particle side of a weight cumulative particle size distribution, respectively.

The present invention also provide a process for producing a metal matrix composite which comprises infiltrating a molten metal into α-alumina powder under pressure or non-pressure, said α-alumina powder comprises polyhedral primary particles having substantially no fracture surface, D50 is 0.1 μm to 50 μm and a ratio of D50 to D10 is not more than 2, wherein D10 and D50 are particle sizes at 10% and 50% cumulation from the smallest particle side of a weight cumulative particle size distribution, respectively.

DETAILED DESCRIPTION OF THE INVENTION

Hereinafter, the metal matrix composite of the present invention and process for producing the same will be explained in detail.

Firstly, the α-alumina powder used as the reinforcement in the metal matrix composite of the present invention will be explained.

In the present invention, α-alumina powder is used as the reinforcement. Alumina other than the α-alumina is called as a transition alumina, which is not a stable compound necessarily and the strength of transition alumina particles is low. Therefore, the metal matrix composite using the transition alumina particles as the reinforcement is inferior in mechanical strength and wear resistance.

The α-alumina powder used as the reinforcement in the present invention has substantially no fracture surface. In the present invention, α-alumina powder which was not ground in the production process is used. In comparison with the α-alumina powder produced without grinding process, α-alumina powder ground in the production process contains a great number of strain and, therefore, the strength of particles is low. The metal matrix composite using such α-alumina powder as the reinforcement is inferior in mechanical strength and wear resistance.

The α-alumina powder used as the reinforcement in the present invention comprises the powder of polyhedral primary particles. Since the shape of the primary particles is a polyhedron, the particles are not easily slided and rotated on the interface between the matrix and the α-alumina particles, in comparison with a sphere, when a mechanical force is applied on the composite. Accordingly, the metal matrix composite using said α-alumina powder as the reinforcement is superior in characteristics such as mechanical strength, wear resistance, etc. Further, the term "polyhedral primary particles" used in the present invention means particles whose surface is composed of eight or more flat faces. In addition, particles whose arris part formed by intersecting faces each other becomes slightly round are also included in the polyhedral primary particles in the present invention.

Regarding the α-alumina powder used as the reinforcement in the present invention, D10 and D50 are particle sizes at 10% and 50% cumulation from the smallest particle side of a weight cumulative particle size distribution, respectively. D50 is 0.1 to 50 μm, preferably 0.3 to 30 μm. The metal matrix composite using α-alumina powder having D50 of less than 0.1 μm as the reinforcement is inferior in wear resistance. In case of the metal matrix composite obtained by infiltrating a molten metal, particularly, it becomes difficult to conduct infiltration because the particle size of the α-alumina powder is small. On the other hand, the metal matrix composite using α-alumina powder having D50 of larger than 50 μm as the reinforcement is inferior in mechanical strength.

Regarding the α-alumina powder used as the reinforcement in the present invention, D10 and D50 are particle sizes at 10% and 50% cumulation from the smallest particle side of a weight cumulative particle size distribution, respectively. A ratio of D50 to D10 is not more than 2, preferably not more than 1.7. The minimum value of the ratio of D50 to D10 is 1. When the ratio of D50 to D10 exceeds 2, the proportion of small particles is increased and, therefore, packing properties are inferior. The metal matrix composite using this powder as the reinforcement is inferior in mechanical strength and wear resistance.

The metal matrix composite of the present invention contains the α-alumina powder as the reinforcement. The amount of α-alumina powder is 2 to 80 volume %, preferably 40 to 80 volume %, more preferably 50 to 70 volume %. When the amount of the α-alumina powder is less than 2 volume %, the strength and wear resistance of the metal matrix composite become insufficient due to lack of the reinforcement. On the other hand, when the amount exceeds 80 volume %, it becomes difficult to produce the composite and, at the same time, the mechanical strength and wear resistance of the composite are lowered due to lack of the amount of the metal matrix. The volume % of α-alumina powder in the metal matrix composite is generally determined by comparing the density of the metal(s) of the matrix with the density of metal matrix composite using the true density of the α-alumina powder.

Regarding the α-alumina powder used as the reinforcement in the present invention, a ratio of long diameter to short diameter of the polyhedral primary particles is preferably less than 5, more preferably less than 3. The minimum value of the ratio of long diameter to short diameter is 1. At this time, the length of the long diameter becomes the same as that of the short diameter. When the ratio of the long diameter to short diameter becomes not less than 5, packing properties of the α-alumina powder become inferior and an anisotropy may be appeared to the metal matrix composite. This reason is as follows. That is, the α-alumina particles are oriented in the perpendicular direction to the direction which infiltrates a molten metal as the matrix, or to the direction of deformation in a hot working, in the production process of the metal matrix composite, so the mechanical strength and wear resistance are different in respective direction of the composite.

Regarding the α-alumina powder used as the reinforcement in the present invention, a ratio of D90 to D10 is preferably not more than 3, more preferably not more than 2.5, wherein D10 and D90 are particle sizes at 10% and 90% cumulation from the smallest particle side of a weight cumulative particle size distribution, respectively. The minimum value of the ratio of D90 to D10 is 1. When the ratio of D90 to D10 exceeds 3, the proportion of coarse and fine particles is large and, therefore, the metal matrix composite using such powder as the reinforcement may be inferior in mechanical strength and wear resistance.

Regarding the α-alumina powder used as the reinforcement in the present invention, a ratio of D50 to the particle diameter calculated from a BET specific surface area mesurement is preferably not more than 2, more preferably not more than 1.5, wherein D50 is a particle size at 50% cumulation from the smallest particle side of a weight cumulative particle size distribution. When the ratio of D50 to the particle diameter calculated from a BET specific surface area mesurement exceeds 2, the metal matrix composite using this α-alumina powder as the reinforcement may be inferior in mechanical strength and wear resistance, because internal defects are liable to arise due to adsorbed water and micro irregularities on the surface of the particles.

The α-alumina powder which can be used as the reinforcement in the present invention can be obtained, for example, by calcining a transition alumina or an alumina precursor, which can be converted into the transition alumina by a heat treatment, in an atmospheric gas comprising hydrogen chloride gas, or chlorine gas and steam (described in Japanese Patent Kokai (laid-open) No. 6-191833 or 6-191836).

The concentration of hydrogen chloride gas is not less than 1 volume %, preferably not less than 5 volume %, more preferably not less than 10 volume %, based on the total volume of the atmospheric gas.

The concentration of chlorine gas is not less than 1 volume %, preferably not less than 5 volume %, more preferably not less than 10 volume %., based on the total volume of the atmospheric gas. The concentration of steam is not less than 0.1 volume %, preferably not less than 1 volume %, more preferably not less than 5 volume %, based on the total volume of the atmospheric gas.

The calcining temperature is not less than 600° C., preferably 600° to 1400° C., more preferably 800° to 1200° C.

As the calcining time depends on the concentration of hydrogen chloride gas or chlorine gas and calcining temperature, it is not specifically limited, but is preferably 1 minute, more preferably 10 minutes.

In addition, a supply source of the atmospheric gas, supply method and calcining device are not specifically limited.

The α-alumina powder used as the reinforcement in the present invention is also characterized by high packing property, so it is possible to obtain a composite having high volume fraction of the reinforcement, i.e. excellent mechanical strength and wear resistance, by using said α-alumina powder.

In addition, the α-alumina powder used as the reinforcement in the present invention is characterized in that it easily forms a composite even in the case of adding to a molten metal or a molten metal at the semi-solid state.

In the present invention, it is also possible to use a mixture of α-alumina powders having two or more different particle sizes as the reinforcement. It is also possible to use other reinforcement in combination with the α-alumina powder used as the reinforcement in the present invention. Examples of the other reinforcements which can be used in combination with the α-alumina powder include fibers and whiskers of alumina; and powders, fibers and whiskers of silicon carbide, aluminum nitride, silicon nitride, titanium diborate, aluminum borate, carbon, etc.

Examples of the metal constituting the matrix of the metal matrix composite of the present invention include aluminum, copper, magnesium, nickel, iron, titanium, etc. Among them, aluminum is preferably used. In the present invention, it will be defined that the metal constituting the matrix also include an alloy of said metal and other metal. For example, in case of aluminum, an aluminum alloy may also be included. When the aluminum matrix composite is produced by a non-pressure infiltration method, it is particularly preferred to use an aluminum alloy containing 0.5 to 15 % by weight of magnesium as the matrix.

In addition, the amount of the other alloy element and an impurity element is not specifically limited. For example, it is about a chemical composition defined in "JIS H 5202: Aluminum Alloy Castings" and "JIS H 4000: Aluminum and Aluminum Alloy Sheets and Plates, Strips and Coiled Sheets".

The process for producing the metal matrix composite of the present invention is not specifically limited. For example, there can be used a solid phase method comprising the steps of mixing metal powder with α-alumina powder, molding and sintering, followed by densification due to hot working or hot press to obtain a composite, or a liquid phase method such as stir-casting method, pressure infiltration method, non-pressure infiltration method, atomize-co-deposition method, etc. It is also possible to use a method comprising the steps of adding α-alumina powder to a metal at the semi-solid state and stirring.

Next, the process for producing the metal matrix composite of the present invention will be explained. In order to secure the high mechanical strength and good wear resistance of the resulting composite, there can be used a method comprising infiltrating a molten metal into the above α-alumina powder used as the reinforcement, under pressure or non-pressure. The molten metal can be easily infiltrated into the α-alumina powder used in the present invention under pressure or no pressure, and the resulting composite is superior in mechanical strength and wear resistance. Therefore, the α-alumina powder is suitable for the method of infiltrating under pressure or non-pressure.

The pressure infiltration of the molten metal into the α-alumina powder can be conducted, for example, by contacting the metal at the molten state with the molded article made of the α-alumina powder and applying a hydrostatic pressure to this molten metal. As the method of applying the hydrostatic pressure, there can be used a method of using a mechanical force such as hydraulic pressure, a method of using an atmospheric pressure or a pressure of a gas cylinder, a method of using a centrifugal force, etc.

The non-infiltration of the molten metal into the α-alumina powder can be conducted, for example, by contacting a magnesium-containing aluminum at the molten state into contact with the molded article made of the α-alumina powder in an atmosphere containing a nitrogen gas.

Next, characteristics of the metal matrix composite using aluminum as the metal constituting the matrix will be explained.

Regarding the aluminum matrix composite of the present invention, it is preferred that the three-point bending strength defined in "JIS R 1601: Bending Strength Testing Method of Fine Ceramics" is not less than 70 kgf/mm$^2$.

Regarding the aluminum matrix composite of the present invention, it is preferred that the bending reinforcing factor of the three-point bending strength represented by the following equation is not less than 0.6.

Bending reinforcing factor=(Bending strength of composite−Bending strength of matrix aluminum)/Volume % of α-alumina powder in composite That is, the term "bending reinforcing factor" means an increase in bending strength per 1 volume % of α-alumina powder in the aluminum matrix composite. The larger this numerical value is, the higher the function of the reinforcement becomes.

It is preferred that the aluminum matrix composite of the present invention has a tensile strength of not less than 42 kgf/mm$^2$.

Regarding the aluminum matrix composite of the present invention, it is preferred that the tensile reinforcing factor of the tensile strength represented by the following equation is not less than 0.25.

Tensile reinforcing factor=(Tensile strength of composite−Tensile strength of matrix aluminum)/Volume % of α-alumina powder in composite That is, the term "tensile reinforcing factor" means an increase in tensile strength per 1 volume % of α-alumina powder in the aluminum matrix composite. The larger this numerical value is, the higher the function of the reinforcement becomes.

It is preferred that the aluminum matrix composite of the present invention has an abrasive wear loss to carbon steels for machine structural use of not more than $2.5\times10^{-10}$ mm$^2$/kgf. The term "Carbon Steels for Machine Structural Use" used herein means the steel material defined in "JIS G 4051: Carbon Steels for Machine Structural Use. The abrasive wear loss can be measured, for example, by using an Ogoshi type wear testing machine or a pin-on-disk type wear testing machine.

Furthermore, it is preferred that the aluminum matrix composite of the present invention has Vickers hardness defined in "JIS Z 2251: Microhardness Testing Method" of not less than 320.

In addition, regarding the aluminum matrix composite of the present invention, it is preferred that a thermal conductivity of α-alumina powder including an interfacial resistance between the matrix and α-alumina powder is not less than 30 W/mK. The thermal conductivity of the aluminum matrix composite containing a Vf volume fraction of α-alumina powder as the reinforcement (Introduction to Ceramics, Second Edition, page 636) is represented by the following equation:

$$Kt=Km\times\{1+2Vf(1-Km/Kp)/(2Km/Kp+1)\}+\{1-Vf(1-Km/Kp)/(2Km/Kp+1)$$

wherein Km is a thermal conductivity of a matrix aluminum, and Kp is a thermal conductivity of α-alumina powder, also including an interfacial resistance between the matrix and α-alumina powder.

Kp is decided by the thermal conductivity of the α-alimina powder particles per se and the magnitude of the interfacial resistance between the α-alumina powder and the matrix. The larger the value of Kp is, the larger the value of Kt becomes. As a result, the thermal conductivity of the composite is improved.

The α-alumina powder used as the reinforcement in the present invention contains little strain because of no grinding process. Therefore, the thermal conductivity of particles per se is high. In addition, the powder have substantially no fracture surface on the surface thereof and is comparatively flat, therefore, internal defects such as gap, etc. are not easily formed between the powders and matrix, that is, the interfacial resistance is small. Accordingly, when the volume fraction of the α-alumina powder as the reinforcement is the same, the composite of the present invention is superior in thermal conductivity.

The metal matrix composite of the present invention has excellent mechanical strength and high wear resistance. Particularly, the aluminum matrix composite can be used for applications which require specific strength, wear resistance, etc., for example, various parts for internal combustion engine (e.g. piston, liner, retainer, head, etc.), brake peripheral parts (e.g. rotor disc, caliper, etc.), operating parts for precision device, etc.

The following Examples further illustrate the present invention in detail but are not to be construed to limit the scope thereof.

Various measurements in the present invention were conducted as follows.

1. Identification of crystal phase of alumina powder

It was identified by the measurement of X-ray diffraction (RAD-γC, manufactured by Rigaku Industrial Corporation).

2. Presence or absence of fracture surface of aluminum particles and evaluation of shape of primary particles It was judged by a SEM (scanning electron microscope JSM-T220, manufactured by JEOL Ltd.) photograph of alumina powder. A ratio of the long diameter to short diameter of alumina particles was obtained by selecting five particles in the SEM photograph, measuring the long diameters and short diameters of alumina particles and calculating from the average value thereof.

3. Measurement of particle size distribution of alumina powder

It was measured by a Master Sizer (Model MS20, manufactured by Malvern Instruments Ltd.) according to a laser scattering method as the measuring principle to determine D10, D50 and D90 values.

4. Measurement of volume % of alumina powder in aluminum matrix composite

Regarding the resulting composite and a sample made of only matrix aluminum produced separately, a density ρc of the composite and a density ρm of the matrix were measured using a density measuring device (SGM-AEL, manufactured by Shimadzu Corporation), and then the volume fraction(%) of the alumina powder was determined from the following equation:

$$Volume\ fraction(\%)=100\times(\rho c-\rho m)/(3.96-\rho m)$$

wherein a true density of the alumina powder is 3.96.

5. Measurement of BET specific surface area

A BET specific surface area was measured by a Flowsorb (Model 2300, manufactured by Micromeritics Instrument Co., Ltd.).

6. Measurement of three-point bending strength

It was measured by an Auto Graph (DSS-500, manufactured by Shimadzu Corporation) according to "JIS R 1601: Bending Strength Testing Method of Fine Ceramics"

7. Measurement of tensile strength

It was measured by an Auto Graph (IS-500, manufactured by Shimadzu Corporation) using a tensile test specimen having a size of 40 mm in length, 3 mm in thickness, 4 mm in width of parallel parts of both sides, 2 mm in width of the central part and 60 mm in curvature radius (R) of the central concave part.

8. Measurement of abrasive wear loss to carbon steels for machine structural use.

It was measured by an Ogoshi type rapid wearing testing machine (OAT-U, manufactured by Tokyo Testing Machine Mfg Co., Ltd.) using a truck wheel of the material S45C defined in "JIS G 4051: Carbon Steels for Machine Structural Use" at the lubricating state (machine oil #68).

9. Vickers hardness

It was measured by a Vickers hardness tester (AVK, manufactured by Akashi Seisakusho Co., Ltd.) 10. Thermal conductivity of α-alumina powder, also including interfacial resistance between the matrix and α-alumina powder.

A thermal conductivity Kt of the resulting composite and a thermal conductivity Km of the matrix aluminum produced separately were measured by a laser flash type thermal constant measuring device (Model TC-700, manufactured by Sinku-Riko, Inc.), and then a thermal conductivity Kp of the α-alumina powder, also including the interfacial resistance was determined from the following equation:

$$Kt=Km\times\{1+2Vf(1-Km/Kp)/(2Km/Kp+1)\}+\{1-Vf(1-Km/Kp)/(2Km/Kp+1)$$

wherein Vf is a volume fraction of the α-alumina powder contained in the composite.

The α-alumina powders used in the Examples are as shown below.

1. Alumina A

α-alumina shown in A of Table 1

2. Alumina B

α-alumina shown in B of Table 1

3. Alumina C

α-alumina shown in C of Table 1

4. Alumina D

α-alumina shown in D of Table 1

TABLE 1

| Alumina | A | B | C | D |
|---|---|---|---|---|
| Crystalline phase | α-Alumina | α-Alumina | α-Alumina | α-Alumina |
| Presence or absence of fracture surface | None | None | None | Presence |
| Shape of primary particle | Polyhedron | Polyhedron | Polyhedron | Undetermined shape |
| Number of faces of primary particles | 16~22 | 16~20 | 14~20 | — |
| Ratio of long diameter to short diameter | 1.6 | 1.2 | 1.2 | 2.0 |
| D50 | 21 μm | 12 μm | 5.5 μm | 18 μm |
| D50/D10 | 1.5 | 1.4 | 1.6 | 1.5 |
| D90/D10 | 2.3 | 2.0 | 2.4 | 2.3 |
| D50/BET* | 1.4 | 1.6 | 1.4 | 2.3 |

*Particle diameter calculated from a BET specific surface area.

The matrix metals used in the Examples are as shown below.

1. Matrix A

Aluminum containing 10.5 % by weight of magnesium, prepared by using aluminum having a purity of 99.9 % by weight and magnesium having a purity of 99.97 % by weight. The chemical composition is shown in A of Table 2.

2. Matrix B

1-B Alloy defined in "JIS H 5202: Aluminum Alloy Castings". The chemical composition is shown in B of Table 2.

3. Matrix C

6061 Alloy defined in "JIS H 4000: Aluminum and Aluminum Alloy Sheets and Plates, Stripes and Coiled Sheets". The chemical composition is shown in C of Table 2.

4. Matrix D

8-A Alloy defined in "JIS H 5202: Aluminum Alloy Castings". The chemical composition is shown in D of Table 2.

TABLE 2

| Matrix | Cu | Si | Mg | Fe | Ni | Ti | Cr |
|---|---|---|---|---|---|---|---|
| A | — | 0.02 | 10.5 | 0.03 | — | — | — |
| B | 4.8 | 0.03 | 0.35 | 0.08 | — | 0.17 | — |
| C | 0.21 | 0.7 | 1.0 | 0.18 | — | — | 0.16 |
| D | 0.9 | 11.7 | 1.0 | 0.16 | 1.2 | 0.12 | — |

(% by weight)

The processes for producing the metal matrix composite used in the Examples are the following two kinds of methods comprising infiltrating a molten metal into alumina powder.

1. Infiltration method A (non-pressure infiltration method)

Alumina powder was charged in a graphite crucible and molded under a pressure of 100 or 300 kgf/cm$^2$. Then, a matrix metal was placed thereon and, after heating in a nitrogen atmosphere at 900° C. for 5 to 10 hours, the resultant was cooled.

2. Infiltration method B (pressure infiltration method)

Alumina powder was charged in a graphite crucible, or alumina powder was molded under a pressure of 100 kgf/cm$^2$ after charging. Then, a matrix metal was placed thereon and, after heating in air at 700° C. for 30 minutes, the molten metal was pressurized under a pressure of 12.5 kgf/cm$^2$ for 5 minutes, followed by cooling while maintaining the pressurized state.

EXAMPLE 1

A matrix A (aluminum-10.5 wt % magnesium alloy) was infiltrated into alumina powder A according to the infiltration method A to obtain a composite 1. After the resulting composite 1 was subjected to a heat treatment (430° C. ×18 hours), the volume % of alumina powder, three-point bending strength, bending reinforcing factor, tensile strength and tensile reinforcing factor were determined. The results are shown in Table 3.

EXAMPLE 2

A matrix A (aluminum-10.5 wt % magnesium alloy) was infiltrated into alumina powder C according to the infiltration method A to obtain a composite 2. After the resulting composite 2 was subjected to a heat treatment (430° C. ×18 hours), the volume % of alumina powder, three-point bending strength, bending reinforcing factor, tensile strength and tensile reinforcing factor were determined. The results are shown in Table 3.

EXAMPLE 3

A matrix A (aluminum-10.5 wt % magnesium alloy) was infiltrated into alumina powder A according to the infiltration method B to obtain a composite 3. After the resulting composite 3 was subjected to a heat treatment (430° C. ×18 hours), the volume % of alumina powder, three-point bending strength, bending reinforcing factor, tensile strength and tensile reinforcing factor were determined. The results are shown in Table 3.

COMPARATIVE EXAMPLE 1

After the same aluminum (aluminum-10.5 wt % magnesium alloy) as that of the matrix A was subjected to a heat treatment (430° C.×18 hours), three-point bending strength and tensile strength were determined. The results are shown in Table 3.

COMPARATIVE EXAMPLE 2

A matrix A (aluminum-10.5 wt % magnesium alloy) was infiltrated into alumina powder D according to the infiltration method A to obtain a composite 4. After the resulting composite 4 was subjected to a heat treatment (430° C. ×18 hours), the volume % of alumina powder, three-point bending strength, bending reinforcing factor, tensile strength and tensile reinforcing factor were determined. The results are shown in Table 3.

COMPARATIVE EXAMPLE 3

A matrix A (aluminum-10.5 wt % magnesium alloy) was infiltrated into alumina powder D according to the infiltration method B to obtain a composite 5. After the resulting composite 5 was subjected to a heat treatment (430° C. ×18 hours), the volume % of alumina powder, three-point bending strength, bending reinforcing factor, tensile strength and tensile reinforcing factor were determined. The results are shown in Table 3.

EXAMPLE 4

A matrix B (JIS 1-B alloy) was infiltrated into alumina powder A according to the infiltration method B to obtain a composite 6. After the resulting composite 6 was subjected to a heat treatment (515° C.×10 hours and 160° C.×4 hours), the volume % of alumina powder, three-point bending strength, bending reinforcing factor, tensile strength and tensile reinforcing factor were determined. The results are shown in Table 3.

EXAMPLE 5

A matrix B (JIS 1-B alloy) was infiltrated into alumina powder B according to the infiltration method B to obtain a composite 7. After the resulting composite 7 was subjected to a heat treatment (515° C.×10 hours and 160° C.×4 hours), the volume % of alumina powder, three-point bending strength, bending reinforcing factor, tensile strength and tensile reinforcing factor were determined. The results are shown in Table 3.

COMPARATIVE EXAMPLE 4

After the same aluminum (JIS 1-B alloy) as that of the matrix B was subjected to a heat treatment (515° C.×10 hours and 160° C.×4 hours), three-point bending strength and tensile strength were determined. The results are shown in Table 3.

COMPARATIVE EXAMPLE 5

A matrix B (JIS 1-B alloy) was infiltrated into alumina powder D according to the infiltration method B to obtain a composite 8. After the resulting composite 8 was subjected to a heat treatment (515° C.×10 hours and 160° C.×4 hours), the volume % of alumina powder, three-point bending strength, bending reinforcing factor, tensile strength and tensile reinforcing factor were determined. The results are shown in Table 3.

EXAMPLE 6

A matrix C (JIS 6061 alloy) was infiltrated into alumina powder A according to the infiltration method B to obtain a composite 9. After the resulting composite 9 was subjected to a heat treatment (515° C.×10 hours and 160° C.×18 hours), the volume % of alumina powder, three-point bending strength, bending reinforcing factor, tensile strength and tensile reinforcing factor were determined. The results are shown in Table 3.

COMPARATIVE EXAMPLE 6

After the same aluminum (JIS 6061 alloy) as that of the matrix C was subjected to a heat treatment (515° C.×10 hours and 160° C.×18 hours), three-point bending strength and tensile strength were determined. The results are shown in Table 3.

COMPARATIVE EXAMPLE 7

A matrix C (JIS 6061 alloy) was infiltrated into alumina powder D according to the infiltration method B to obtain a composite 10. After the resulting composite 10 was subjected to a heat treatment (515° C.×10 hours and 160° C.×18 hours), the volume % of alumina powder, three-point bending strength, bending reinforcing factor, tensile strength and tensile reinforcing factor were determined. The results are shown in Table 3.

COMPARATIVE EXAMPLE 8

After the same aluminum (JIS 8-A alloy) as that of the matrix D was subjected to a heat treatment (515° C.×4 hours and 170° C.×10 hours), the abrasive wear loss to carbon steels for machine structural use and Vickers hardness were determined. The results are shown in Table 4.

COMPARATIVE EXAMPLE 9

A matrix D (JIS 8-A alloy) was infiltrated into alumina powder D according to the infiltration method B to obtain a composite 12. After the resulting composite 12 was subjected to a heat treatment (510° C.×4 hours and 170° C.×10 hours), the volume % of alumina powder, abrasive wear loss to carbon steels for machine structural use and Vickers hardness were determined. The results are shown in Table 4.

TABLE 4

| | Example 7 | Comparative Example 8 | Comparative Example 9 |
|---|---|---|---|
| Contents | Composite 11 | Matrix D | Composite 12 |
| Alumina | A | — | D |
| Matrix | D | D | D |
| Infiltration method | B | — | B |
| Volume % of alumina | 63 | 0 | 54 |
| Specific abrasive wear loss ($mm^2/kgf$) | 1.8E-10 | 40E-10 | 2.9E-10 |
| Vickers hardness | 380 | 150 | 300 |

EXAMPLE 8

A matrix D (JIS 8-A alloy) was infiltrated into alumina powder A according to the infiltration method B to obtain a composite 13. After the resulting composite 13 was subjected to a heat treatment (510° C.×4 hours and 170° C.×10 hours), the volume % of alumina powder was determined. The composite was cut into two pieces, and the three-point bending strength of one piece was determined as it is and that of another piece was determined after inflicting a thermal fatigue (400° C.×300 cycles). The results are shown in Table 5.

TABLE 3

| | Contents | Alumina | Matrix | Infiltration method | Volume % of alumina | Bending strength ($kgf/mm^2$) | Bending reinforcing factor | Tensile strength ($kgf/mm^2$) | Tensile reinforcing factor |
|---|---|---|---|---|---|---|---|---|---|
| Example 1 | Composite 1 | A | A | A | 64 | 82 | 0.69 | 46 | 0.26 |
| Example 2 | Composite 2 | C | A | A | 60 | 87 | 0.82 | 50 | 0.35 |
| Example 3 | Composite 3 | A | A | B | 58 | 78 | 0.69 | 45 | 0.28 |
| Comparative Example 1 | Matrix A | — | A | — | 0 | 38 | — | 29 | — |
| Comparative Example 2 | Composite 4 | D | A | A | 52 | 61 | 0.44 | 30 | 0.02 |
| Comparative Example 3 | Composite 5 | D | A | B | 56 | 67 | 0.52 | 40 | 0.20 |
| Example 4 | Composite 6 | A | B | B | 60 | 94 | 0.88 | 52 | 0.52 |
| Example 5 | Composite 7 | B | B | B | 60 | 104 | 1.00 | 57 | 0.60 |
| Comparative Example 4 | Matrix B | — | B | — | 0 | 44 | — | 21 | — |
| Comparative Example 5 | Composite 8 | D | B | B | 47 | 68 | 0.51 | 41 | 0.43 |
| Example 6 | Composite 9 | A | C | B | 59 | 87 | 0.56 | 49 | 0.46 |
| Comparative Example 6 | Matrix C | — | C | — | 0 | 54 | — | 22 | — |
| Comparative Example 7 | Composite 10 | C | C | B | 48 | 69 | 0.31 | 43 | 0.44 |

EXAMPLE 7

A matrix D (JIS 8-A alloy) was infiltrated into alumina powder A according to the infiltration method B to obtain a composite 11. After the resulting composite 11 was subjected to a heat treatment (515° C.×4 hours and 170° C.×10 hours), the volume % of alumina powder, abrasive wear loss to carbon steels for machine structural use and Vickers hardness were determined. The results are shown in Table 4.

COMPARATIVE EXAMPLE 10

A matrix D (JIS 8-A alloy) was infiltrated into alumina powder D according to the infiltration method B to obtain a composite 14. After the resulting composite 14 was subjected to a heat treatment (510° C.×4 hours and 170° C.×10 hours), the volume % of alumina powder was determined. The composite was cut into two pieces, and the three-point bending strength of one piece was determined as it is and that of another piece was determined after inflicting a thermal fatigue (400° C.×300 cycles). The results are shown in Table 5.

TABLE 5

| | | Example 8 | Comparative Example 10 |
|---|---|---|---|
| Contents | | Composite 13 | Composite 14 |
| Alumina | | A | D |
| Matrix | | D | D |
| Infiltration method | | B | B |
| Volume % of alumina | | 59 | 52 |
| Tensile strength (kgf/mm$^2$) | Before inflicting thermal fatigue | 58 | 53 |
| | After inflicting thermal fatigue | 53 | 46 |
| Decrease in bending strength (%) | | 9 | 13 |

EXAMPLE 9

A matrix A (aluminum-10.5 wt % magnesium alloy) was infiltrated into alumina powder A according to the infiltration method B to obtain a composite 15. After the resulting composite 15 was subjected to a heat treatment (430° C. ×18 hours), the volume % of alumina powder and thermal conductivity of α-alumina powder, also including interfacial resistance were determined. The results are shown in Table 6.

COMPARATIVE EXAMPLE 11

A matrix A (aluminum-10.5 wt % magnesium alloy) was infiltrated into alumina powder D according to the infiltration method B to obtain a composite 16. After the resulting composite 16 was subjected to a heat treatment (430° C. ×18 hours), the volume % of alumina powder and thermal conductivity of α-alumina powder, also including interfacial resistance were determined. The results are shown in Table 6.

EXAMPLE 10

A matrix D (JIS 8-A alloy) was infiltrated into alumina powder A according to the infiltration method B to obtain a composite 17. After the resulting composite 17 was subjected to a heat treatment (510° C.×4 hours and 170° C.×10 hours), the volume % of alumina powder and thermal conductivity of α-alumina powder, also including interfacial resistance were determined. The results are shown in Table 6.

COMPARATIVE EXAMPLE 12

A matrix D (JIS 8-A alloy) was infiltrated into alumina powder D according to the infiltration method B to obtain a composite 18. After the resulting composite 18 was subjected to a heat treatment (510° C.×4 hours and 170° C.×10 hours), the volume % of alumina powder and thermal conductivity of α-alumina powder, also including interfacial resistance were determined. The results are shown in Table 6.

TABLE 6

| | Example 9 | Comparative Example 11 | Example 10 | Comparative Example 12 |
|---|---|---|---|---|
| Contents | Composite 15 | Composite 16 | Composite 17 | Composite 18 |
| Alumina | A | D | A | D |
| Matrix | A | A | D | D |
| Infiltration method | B | B | B | B |
| Volume % of alumina | 61 | 51 | 60 | 50 |
| Thermal conductivity of α-alumina (W/mK) | 35 | 29 | 32 | 25 |

What is claimed is:

1. A metal matrix composite comprising 2 to 80 volume % of α-alumina powder as a reinforcement, said α-alumina powder comprising polyhedral primary particles having a ratio of the long diameter to short diameter of less than 5, which polyhedral primary particle have no or substantially no fracture surface, wherein D50 of the α-alumina powder is 0.1 μm to 50 μm and a ratio of D50 to D10 of the α-alumina powder is not more than 2, wherein D10 and D50 are particle sizes at 10% and 50% cumulation from the smallest particle side of a weight cumulative particle size distribution, respectively, and wherein the α-alumina powder is a powder having a particle size distribution in which a ratio of D90 to D10 is not more than 3, wherein D10 and D90 are particle sizes at 10% and 90% cumulation from the smallest particle side of a weight cumulative particle size distribution, respectively.

2. The metal matrix composite according to claim 1, wherein the α-alumina powder is the powder in which a ratio of D50 to the particle diameter calculated from a BET specific surface area mesurement is not more than 2, wherein D50 is a particle size at 50% cumulation from the smallest particle side of the weight-cumulative particle size distribution.

3. The metal matrix composite according to claim 1, wherein the amount of the α-alumina powder is 40 to 80 volume %.

4. The metal matrix composite according to claim 1, wherein a metal constituting a matrix is aluminum.

5. An aluminum matrix composite according to claim 4, wherein a three-point bending strength is not less than 70 kgf/mm$^2$.

6. The aluminum matrix composite according to claim 4, wherein a bending reinforcing factor of the three-point bending strength represented by the following equation 1 is not less than 0.6:

Equation 1: Bending reinforcing factor=(Bending strength of composite–Bending strength of matrix aluminum)/Volume % of α-alumina powder in composite.

7. The aluminum matrix composite according to claim 4, wherein a tensile strength is not less than 42 kgf/mm$^2$.

8. The aluminum matrix composite according to claim 4, wherein a tensile reinforcing factor represented by the following equation is not less than 0.25:

Tensile reinforcing factor=(Tensile strength of composite−Tensile strength of matrix aluminum)/Volume % of α-alumina powder in composite.

9. The aluminum matrix composite according to claim 4, wherein an abrasive wear loss to carbon steels for machine structural use is less than $2.5\times10^{-10}$ $mm^2/kgf$.

10. The aluminum matrix composite according to claim 4, wherein Vickers hardness is not less than 320.

11. The aluminum matrix composite according to claim 4, wherein a thermal conductivity of the α-aluminum powder, also including an interfacial resistance between the matrix and α-alimina powder is not less than 30 W/mK.

12. A metal matrix composite according to claim 1, wherein the α-alumina powder comprises polyhedral primary particles having a ratio of long diameter to short diameter of less than 3.

13. A process for producing a metal matrix composite which comprises infiltrating a molten metal into α-alumina powder under pressure or non-pressure, said α-alumina powder comprising polyhedral primary particles having a ratio of the long diameter to short diameter of less than 5, which polyhedral primary particles have no or substantially no fracture surface, wherein D50 of the α-alumina powder is 0.1 μm to 50 μm and a ratio of D50 to D10 of the α-alumina powder is not more than 2, wherein D10 and D50 are particle sizes at 10% and 50% cumulation from the smallest particle side of a weight cumulative particle size distribution, respectively, and wherein the α-alumina powder is a powder having a particle size distribution in which a ratio of D90 to D10 is not more than 3, wherein D10 and D90 are particle sizes at 10% and 90% cumulation from the smallest particle side of a weight cumulative particle size distribution, respectively.

14. The process according to claim 13, wherein the α-alumina powder is the powder in which a ratio of D50 to the diameter calculated from a BET specific surface area measurement is not more than 2, wherein D50 is a particle size at 50% cumulation from the smallest particle side of a weight cumulative particle size distribution.

15. The process according to claim 13, wherein the amount of the α-alumina powder in the metal matrix composite is 40 to 80 volume %.

16. The process according to claim 13, wherein a metal constituting a matrix is aluminum.

17. A process according to claim 13, wherein the α-alumina powder comprises polyhedral primary particles having a ratio of long diameter to short diameter of less than 3.

* * * * *